US006700465B2

(12) United States Patent
Cho

(10) Patent No.: US 6,700,465 B2
(45) Date of Patent: Mar. 2, 2004

(54) MICRO-SWITCHING DEVICE ACTUATED BY LOW VOLTAGE

(75) Inventor: Jin-woo Cho, Kyungki-do (KR)

(73) Assignee: Samsung Electronics Co., Ltd. (KR)

( * ) Notice: Subject to any disclaimer, the term of this patent is extended or adjusted under 35 U.S.C. 154(b) by 6 days.

(21) Appl. No.: 10/202,899

(22) Filed: Jul. 26, 2002

(65) Prior Publication Data

US 2003/0099081 A1 May 29, 2003

(30) Foreign Application Priority Data

Nov. 24, 2001 (KR) ..... 2001-73574

(51) Int. Cl.[7] ..... H01H 51/22; H01H 57/00
(52) U.S. Cl. ..... 335/78; 200/181; 361/233
(58) Field of Search ..... 335/78; 200/181; 361/233; 324/658

(56) References Cited

U.S. PATENT DOCUMENTS 5,124,879 A * 6/1992 Goto ..... 361/233
5,278,368 A * 1/1994 Kasano et al. ..... 200/181
5,664,665 A * 9/1997 Kobayashi et al. .. 200/61.45 M
5,856,722 A * 1/1999 Haronian et al. ..... 310/321
6,144,545 A * 11/2000 Lee et al. ..... 361/233
6,303,885 B1 * 10/2001 Hichwa et al. ..... 200/181
6,424,165 B1 * 7/2002 de Boer et al. ..... 324/754
6,506,989 B2 * 1/2003 Wang ..... 200/181
6,522,801 B1 * 2/2003 Aksyuk et al. ..... 385/18
6,618,184 B2 * 9/2003 Jin et al. ..... 359/291
6,621,387 B1 * 9/2003 Hopcroft ..... 333/262
2003/0029705 A1 * 2/2003 Qiu et al. ..... 200/181

* cited by examiner

*Primary Examiner*—Lincoln Donovan
*Assistant Examiner*—Bernard Rojas
(74) *Attorney, Agent, or Firm*—Burns Doane Swecker & Mathis, LLP

(57) ABSTRACT

A micro-switching device actuated by a low voltage is provided. The micro-switching device includes a spring operating elastically; a membrane formed on one side of the spring, being held by the spring; and a lower electrode formed below the membrane, for generating an electrostatic attraction when a voltage is applied thereto, wherein the membrane is non-planar. This micro-switching device is advantageous in that it can be actuated by a low voltage and prevents the adhesion that occurs commonly in micro devices.

8 Claims, 7 Drawing Sheets

MICRO-SWITCHING DEVICE ACTUATED BY LOW VOLTAGE

Priority is claimed to Patent Application No. 2001-73574 filed in Republic of Korea on Nov. 24, 2001, herein incorporated by reference.

BACKGROUND OF THE INVENTION

1. Field of the Invention

The present invention relates to a micro-switching device actuated by low voltage, using an electrostatic attraction.

2. Description of the Related Art

In general, an RF switch is a kind of switch for turning a device on or off by using electrostatic attraction to bring a structure into contact with a signal line. In this case, a predetermined voltage is applied to the signal line so as to generate an electrostatic attraction required. Here, the voltage required is determined by the rigidity of a spring supporting a microstructure. Preferably, the spring has low rigidity so as to allow actuation by a low voltage.

When a microstructure constituting a micro device is in contact with a signal line or an electrode, they may, however, be adhered to each other. This problem may also occur when a voltage is applied to and then removed from an electrode. As a result, the microstructure is kept in contact with the signal line, thereby preventing the proper switching control of the micro device.

To solve this problem, the restoring capability of an actuated structure must be strengthened, to make the actuated structure return back to its original position. Thus, the structure has to be supported by a spring of high rigidity. However, as described above, the voltage applied to an electrode must be increased in order to use a spring of high rigidity. Nevertheless, a spring of high rigidity is often adopted in a micro switching device at the present time, so as to prevent the adhesion of a micro device to a signal line or an electrode. As a result, the necessary voltage is increased, and thus it is very difficult to make a micro switching device that can be actuated by a low voltage.

FIG. 1A is a perspective view of a conventional micro-switching device. The micro-switching device is supported by anchors 13, which are fixed onto a substrate, and springs 14 which are formed on the anchors 13, and includes a membrane 15 above the substrate, a lower electrode 11 corresponding to the membrane 15, and insulating layers 12. If a voltage is applied to the lower electrode 11, an electrostatic attraction is generated to actuate the springs 14. Then, the membrane 15 approaches the lower electrode 11 due to the electrostatic attraction, comes into contact with a signal line 16, and is then switched on.

FIGS. 1B and 1C are views for explaining defects of a conventional micro-switching device. Here, for convenience's sake, the defects are diagrammatically viewed with regard to a general representation of a conventional micro-switching device. FIG. 1B is a view of a micro-switching device in which a membrane 15 is actuated by applying power to a lower electrode 11, and FIG. 1C is a view of the micro-switching device in which the membrane 15 is actuated and approaches closely to the lower electrode 11. More specifically, while the membrane 15 is not in contact with the lower structure of the lower electrode 11 and insulating layers 12, with its body held by the springs 14, an electrostatic attraction is generated between the membrane 15 and the lower electrode 11 when a voltage is applied to the lower electrode 11, thereby attracting the membrane 15 to the lower electrode 11. At this time, the more closely the membrane 15 approaches the lower electrode 11, the more the electrostatic attraction between the membrane 15 and the lower electrode 11 is increased. As a result, the displacement of the membrane 15 increases. Then, the displacement of the springs 14 increases to increase their restoring capability.

Here, the electrostatic attraction between the membrane 15 and the lower electrode 11 is calculated by the following equation:

$$F_E = \frac{1}{2}\frac{\varepsilon A V^2}{(g_0 - U_z)^2} \tag{1}$$

wherein $F_E$ denotes an electrostatic attraction, A denotes a corresponding area, V denotes voltage applied to the lower electrode 11, $U_z$ denotes the driving distance of the membrane 15, and $g_0$ denotes a distance between the membrane 15 and the lower electrode 11. As shown in the equation (1), an increase in the driving distance $U_z$ of the membrane 15 results in an increase in the electrostatic attraction $F_E$.

The restorability capability of the springs 14 can be expressed by the following equation:

$$F_s = kU_z \tag{2}$$

wherein Fs denotes the restoring capability of the springs 14, k denotes a spring constant, and Uz denotes the displacement of the membrane 15. From the equation 2, it is noted that the restoring capability Fs of the springs 14 increases linearly according to the displacement of the membrane 15.

FIG. 2 is a graph illustrating the relationship between the restoring capability of the springs 14 and the electrostatic attraction due to the displacement of the membrane 15. This graph reveals that the electrostatic attraction changes greatly, and the restoring capability of the springs 14 changes linearly, according to the driving distance of the membrane 15. The electrostatic attraction may be greater than or less than the restoring capability of the springs 14 according to the displacement of the membrane 15. This is caused by the use of a spring having a relatively large spring constant, or a low voltage applied to the lower electrode 11. Then, the driving distance of the membrane 15 is limited, i.e., it is actuated to a predetermined point and does not operate, and thus cannot function as a switch. However, referring to FIG. 2, the electrostatic attraction is always greater than the restoring capability of the springs 14, at which time the membrane 15 becomes in contact with the lower structure of the lower electrode 11, the insulating layer 12, and the signal line 16, due to the electrostatic attraction. At this time, the membrane can function as a switch.

Once a voltage is applied to the lower electrode 11, the membrane 15 comes into contact with the signal line 16, i.e. it is switched on, and thus the electrostatic attraction is far greater than the restoring capability of the springs 14. Then, the voltage is removed to make the membrane 15 switch off. However, adhesion, which is an inherent property of a micro device, may occur between the membrane 15 and the lower structure of the lower electrode 11, the insulating layer 12 and the signal line 16, thereby reducing the restoring capability of the springs 14. To prevent a reduction in the restoring capability of the springs 14, a spring having a large spring constant K may be used, but this is disadvantageous because a high voltage must be applied to the lower electrode 11.

The above problem can be solved by applying a predetermined force to the micro-switching device so that the membrane can return back to its original position without using a spring of high rigidity. That is, a spring of low rigidity is used, and means for applying a predetermined force onto the micro-switching device is additionally installed to separate the membrane from a lower structure.

For instance, electrodes for applying a driving force may be installed at the top as well as the bottom of the membrane. To actuate a microstructure and make it return back to its original position, a voltage is applied to the upper and lower electrodes of a microstructure. Then, the membrane may be driven in both directions, i.e. upward and downward, and thus can be easily separated from the electrodes to return to its original state. However, this method is disadvantageous in that the manufacturing process is complicated, thereby reducing the yield. Also, in fact, it is difficult to obtain sufficient restoring force to actuate the microstructure and return it to its original state with a low voltage.

SUMMARY OF THE INVENTION

To solve the above problems, it is an object of the present invention to provide a micro-switching device that can be actuated by a low voltage, easily deforms with a electrostatic attraction, and prevents the adhesion between elements while using a spring of low rigidity.

To achieve the object, there is provided a micro-switching device, including a spring operating elastically; a membrane formed on one side of the spring, being held by the spring; and a lower electrode formed below the membrane, for generating an electrostatic attraction when a voltage is applied thereto, wherein the membrane is non-planar.

Preferably, the spring is formed on an anchor which is formed on a substrate, and the membrane is actuated not to be in contact with the substrate while being held by the spring.

Preferably, the micro-switching device further includes a means for applying voltage to the membrane and the lower electrode.

Preferably, the lower surface of the membrane has a concave portion or protrusion, and the membrane is cut partially spherical.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1A:
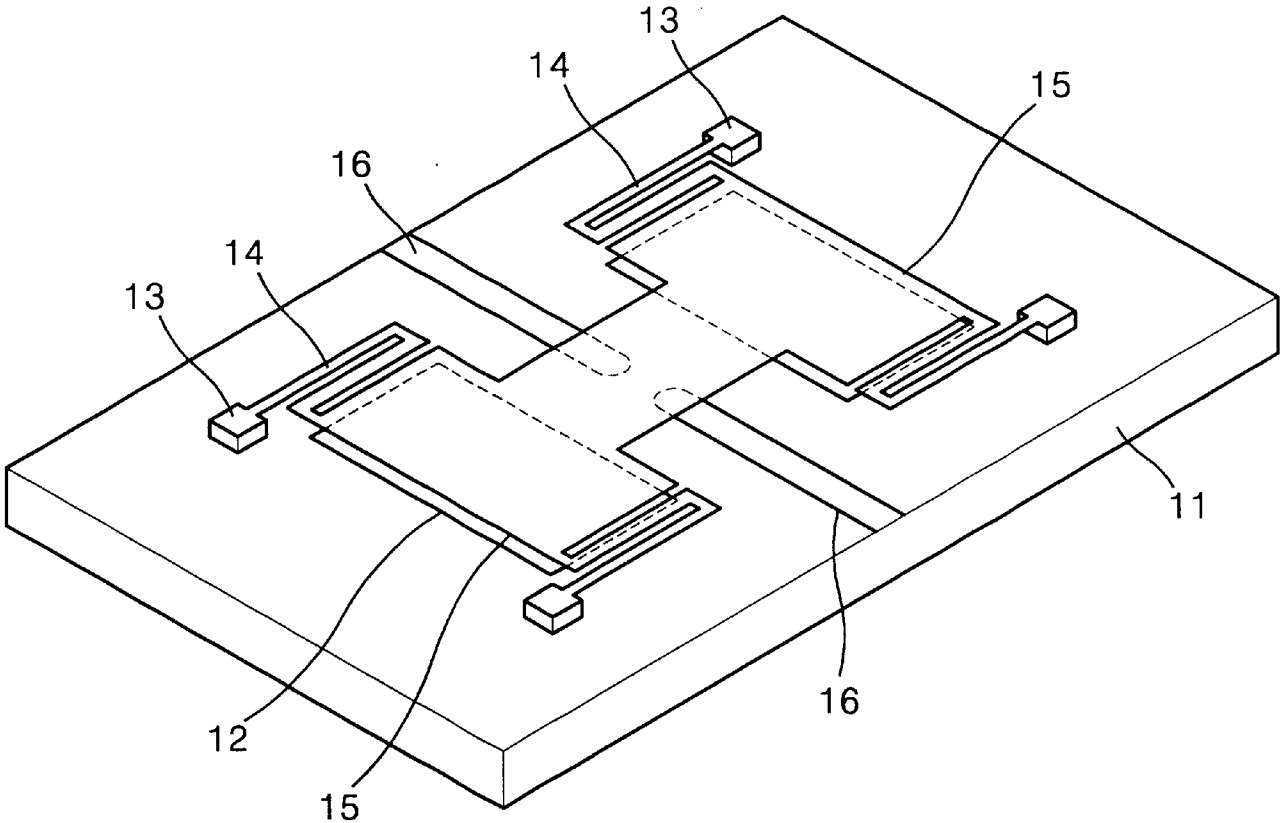
FIG. 1A (PRIOR ART)
FIG. 1A is a perspective view of a conventional micro-switching device.
Figure 1B:
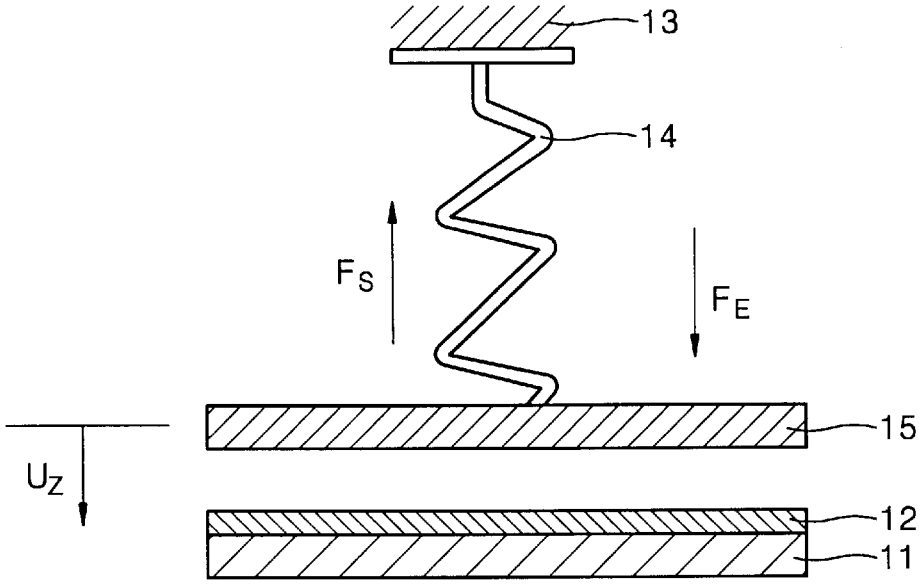
FIG. 1B (PRIOR ART)
FIGS. 1B and 1C are views explaining the operational principles of the conventional micro-switching device of FIG. 1A.
Figure 1C:
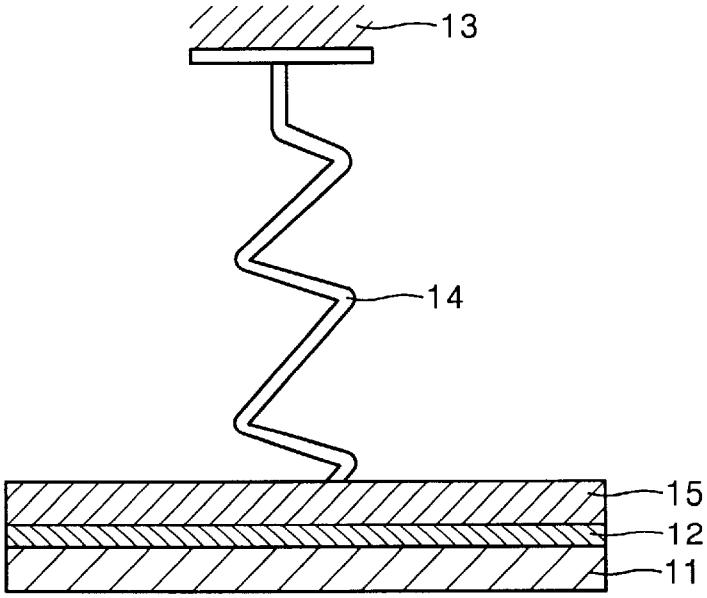
FIG. 1C (PRIOR ART)

Hereinafter, the structure and operational principles of a micro-switching device actuated by a low voltage, according to a preferred embodiment of the present invention, will be described with reference to FIGS. 3A through 3C. The micro-switching device according to the present invention is different from the conventional micro-switching device illustrated in FIGS. 1A through 1C in that the lower surface of a membrane 35 is concave or convex, not planar.

Figure 3A:
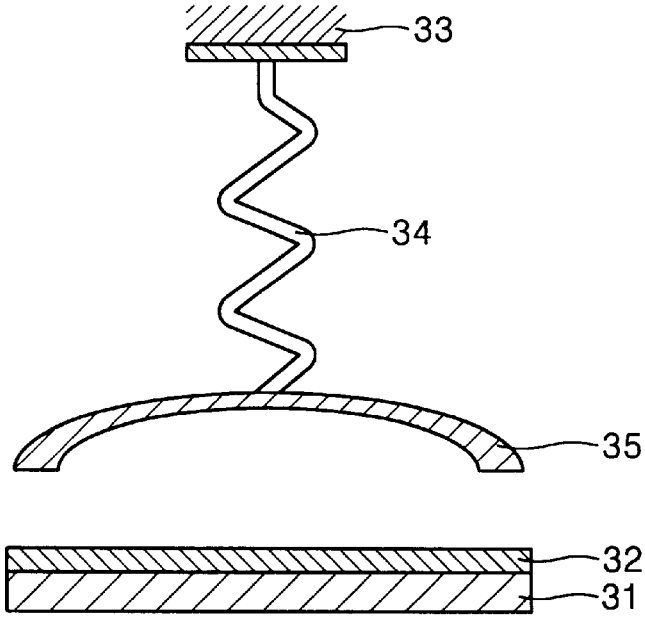
FIGS. 3A through 3C are views explaining a micro-switching device actuated by a low voltage, according to the present invention.
Figure 3B:
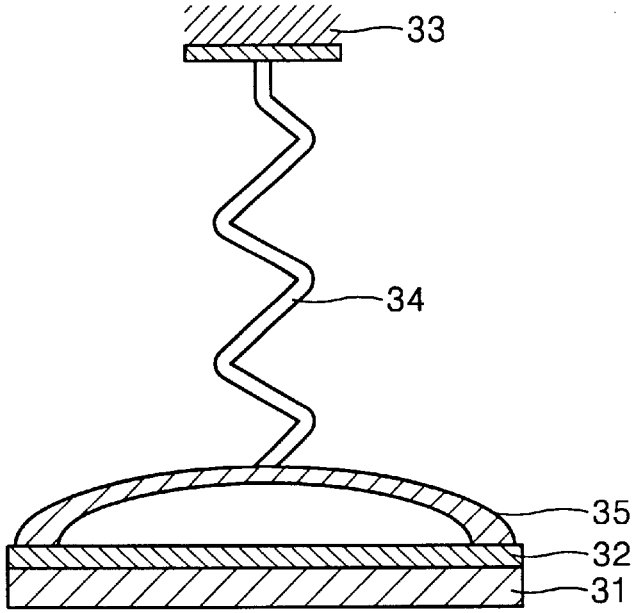
Figure 3C:
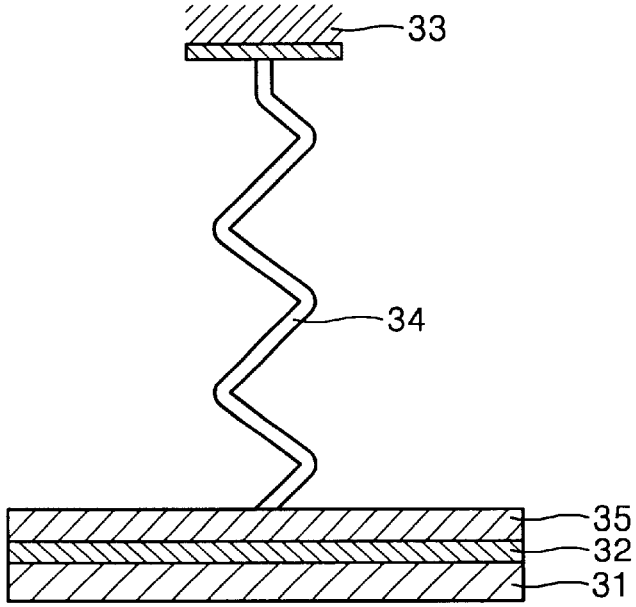

For convenience's sake, a micro switching device having the membrane 35 of predetermined curvature is illustrated conceptually in FIGS. 3A through 3C. More specifically, FIG. 3A shows when the membrane 35 approaches a lower electrode 31 but has yet to contact the lower electrode 31, when voltage is applied to the lower electrode 31. At this time, the shape of the membrane 35 does not transform and still has predetermined curvature.

As shown in FIG. 3B, an increase in the displacement of the membrane 35 results in an increase in the electrostatic attraction. Thus in the event that the displacement of the membrane 35 increases, it comes into contact with a lower structure of a lower electrode 31 and an insulating layer 32, below the membrane 35. In detail, if the displacement of the membrane 35 increases, its lower surface comes into contact with the lower structure and then deforms due to a strong electrostatic attraction between the membrane 35 and the lower structure. In general, a micro-sized membrane is an elastic material, and thus it deforms under a predetermined force. Therefore, due to the electrostatic attraction, the protruding edges of the lower surface of membrane 35 which protrude lower than the rest of the membrane 35 make first contact the lower structure of the lower electrode 31 and insulating layer 32. As a result, the lower surface of the membrane 35, in contact with the lower structure, is semi-spherical as shown in FIG. 3B. Then, as shown in FIG. 3C, the membrane 35 deforms due to the strong electrostatic attraction, bringing its whole lower surface including the concave portion closely into contact with the lower structure 31 and 32.

Here, since the membrane 35 is formed of a material of high rigidity, a strong electrostatic attraction is required to bring the lower surface of the membrane 35 into contact with the lower structure 31 and 32. Referring to FIG. 3B, when the membrane 35 approaches very close to the lower electrode 31, the electrostatic attraction increases greatly. When the membrane 35 is in contact with the lower structure, the micro-switching device is switched on. When a voltage is removed from the lower electrode 31 so as to switch off the micro switching device, the membrane 35 is separated from the lower structure 31 and 32 by the elastic restoring force due to the deformation of the membrane 35, in addition to the restoring capabilities of an anchor 33 and a spring 34.

Figure 2:
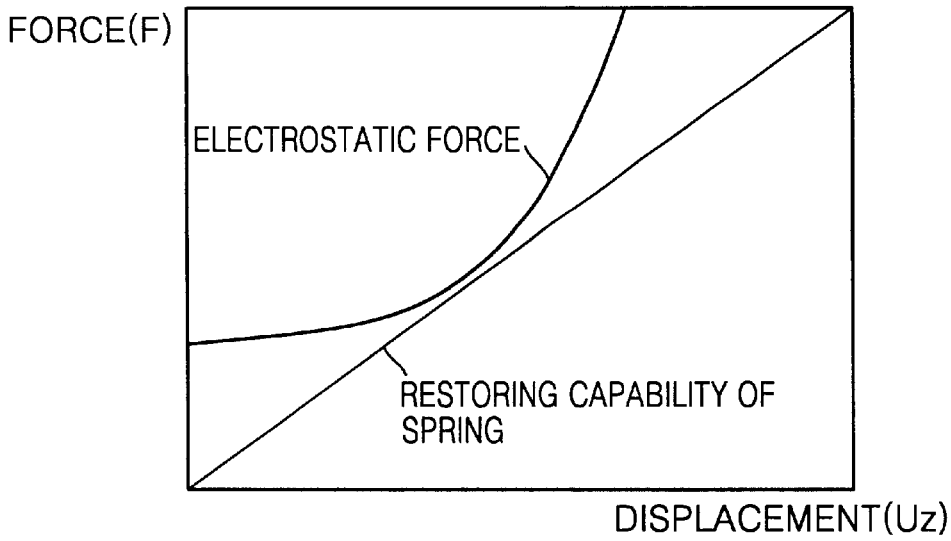
FIG. 2 is a graph illustrating the relationship between an electrostatic attraction and the restoring capability of the spring of FIG. 1A with regard to the driving distance of the membrane of FIG. 1A.
Figure 4:
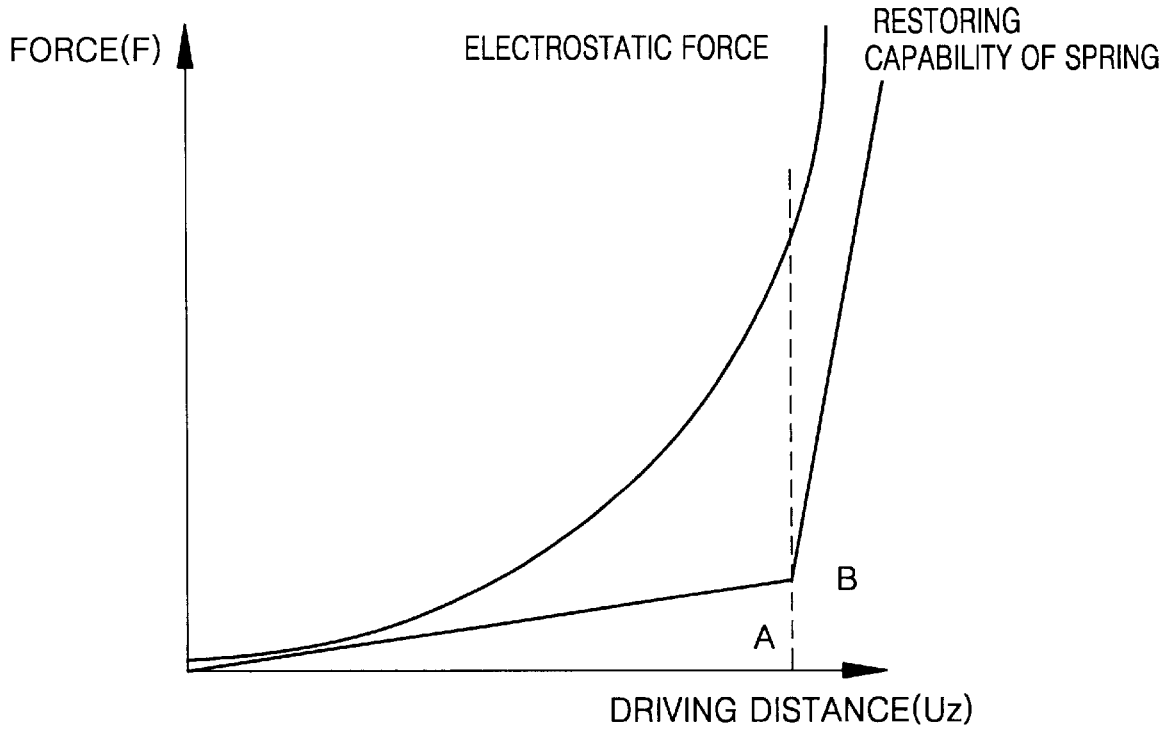
FIG. 4 is a graph illustrating the relationship between an electrostatic attraction and the restoring capability of a spring with regard to the driving distance of a membrane of a micro-switching device, according to the present invention.

In the conventional micro-switching device, the restoring capability of the spring increases linearly with the driving distance of the membrane, whereas in the micro-switching device according to the present invention, the membrane 35 is separated from the lower structure by the deformation of the membranes 35 as well as the restoring capability of the spring 34. Accordingly, the overall restoring capability of the micro-switching device according to the present invention increases nonlinearly with the driving distance Uz of the membrane 35, as illustrated in FIG. 4. More specifically, as can be seen from FIG. 4, an electrostatic attraction (?) and the restoring capability of the micro-switching device according to the present invention increase linearly with the driving distance Uz, if the driving distance Uz is short, i.e., in an "A" region, as in the conventional micro-switching device (see FIG. 2). However, the restoring capability of the micro-switching device according to the present invention increases nonlinearly with the driving distance Uz in a "B" region in which the membrane 35 is in contact with the lower electrode 31, because the deformation of the membrane 35 augments the restoring capability of the spring 34, unlike in a conventional micro-switching device.

Meanwhile, the restoring capability of the micro-switching device is dependent largely on the shape of the membrane. Thus the shape of the membrane is very important in a micro-switching device. Preferably, a micro-switching device actuated by a low voltage includes a spherical membrane having a predetermined curvature. If the lower surface of the membrane is spherical, the circumference of the lower surface of the round membrane comes into contact first with the lower electrode or a signal line. At this time, the lower surface between the edges of the round membrane 35 approach more closely to the lower electrode than the lower surfaces of other membranes having different shapes. Therefore, a relatively high electrostatic attraction is formed between the lower surface of the membrane 35 and the lower electrode 31, so that a large deformation of the membrane 35 can be obtained even though a micro-switching device is actuated by a low voltage.

On the other hand, if the membrane is not round, for instance, it is rectangular, the distance between its lower surface and the lower electrode is greater than that between of the round membrane, when the edges of the lower surface of the membrane are in contact with the lower electrode. Therefore, a relatively high voltage is required to make the concave portion of the membrane contact the lower electrode.

Figure 5A:
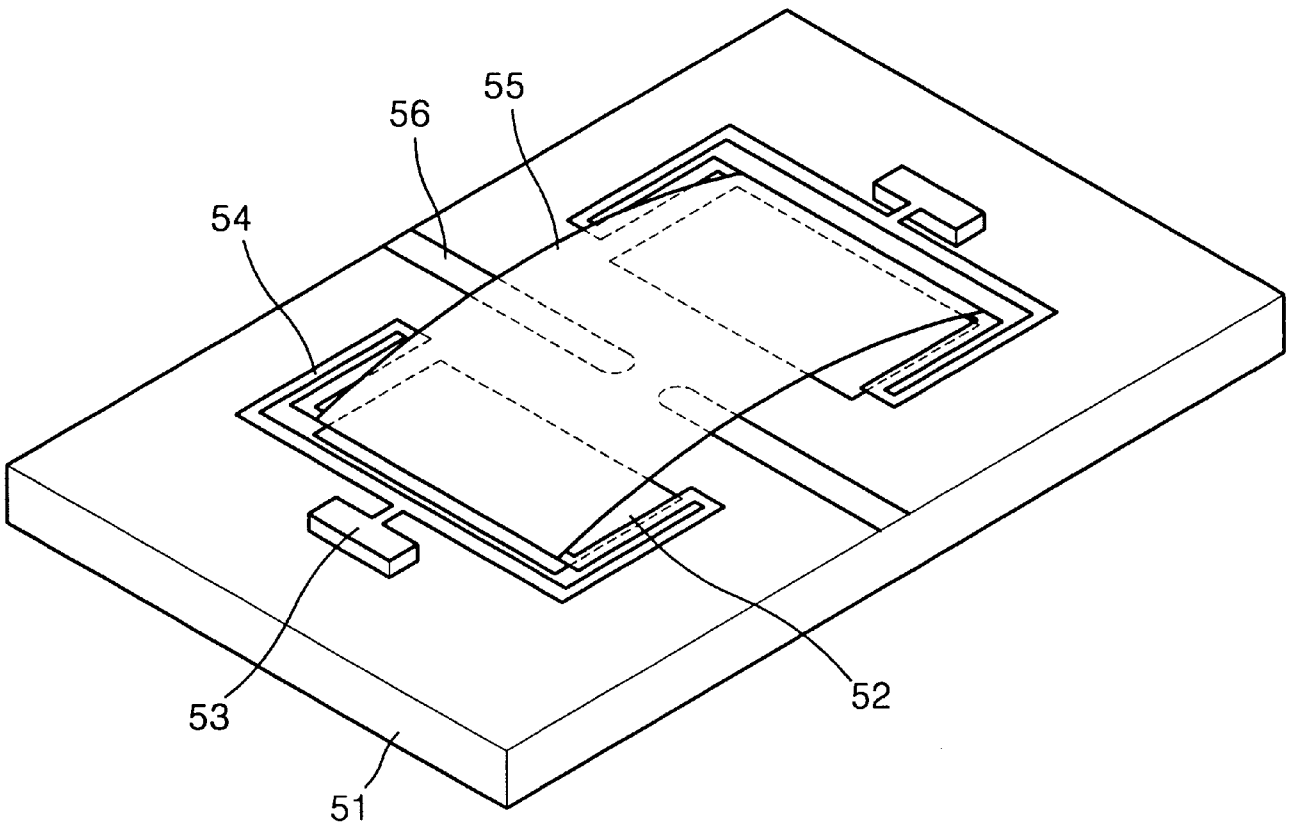
FIGS. 5A through 5C are views of a micro-switching device actuated by a low voltage, according to a preferred embodiment of the present invention.
Figure 5B:
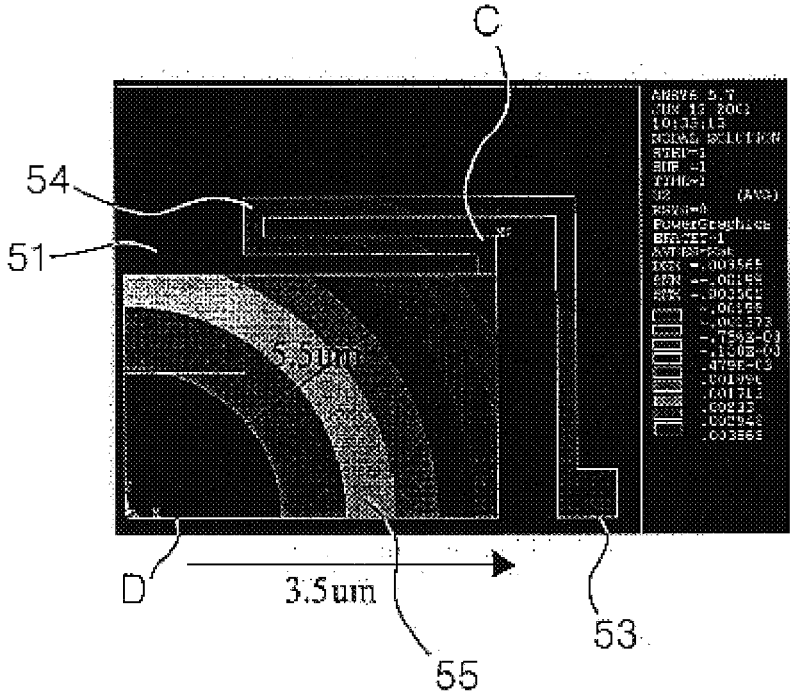
Figure 5C:
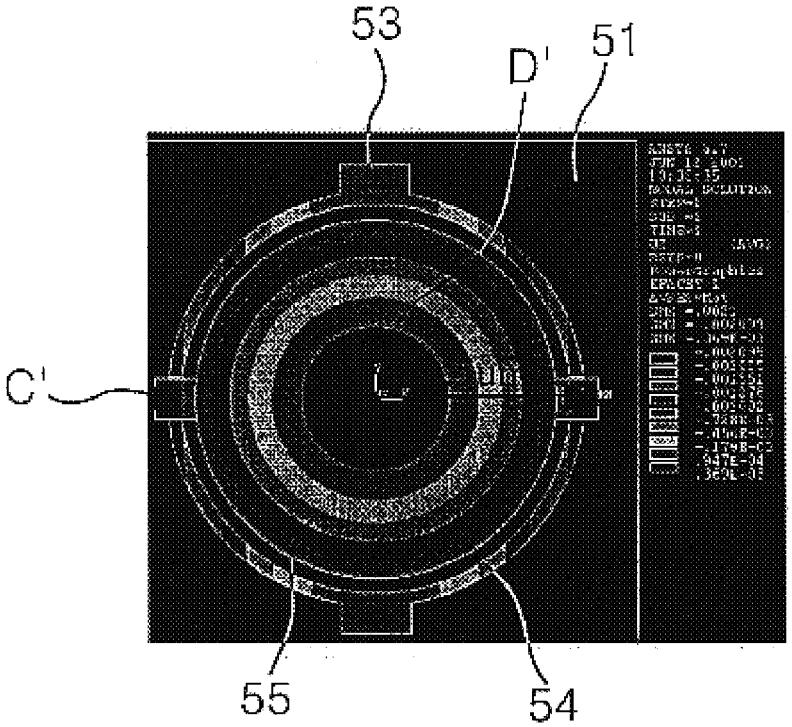

FIGS. 5A through 5C are views of a micro-switching device actuated by a low voltage, according to a preferred embodiment of the present invention. Referring to FIG. 5A, lower electrodes 52 are formed on a substrate 51 to drive a membrane 55. Also, anchors 53 are formed on the substrate 51 to fix springs 54 for supporting the membrane 55 to the substrate 51. The membrane 55 is positioned above the lower electrodes 52, held by the springs 54 fixed to the anchors 53. Below the membrane 55 are formed signal lines 56 in addition to the lower electrodes 52. Here, the membrane 55 is a non-planar type and has predetermined curvature. When a voltage is applied to the lower electrodes 52, the membrane 55 moves toward the lower electrodes 52 due to an electrostatic attraction between the membrane 55 and the lower electrodes 52, and then contacts signal lines 56. As a result, the two separated signal lines 56 are electrically connected to each other, and the micro-switching device is switched on.

FIG. 5B is a view of a quarter of a micro-switching device having a rectangular membrane 55 whose lower circumferences protrude downward and whose center bulges up. FIG. 5C is a view of a micro-switching device having a spherical membrane 55 whose center bulges up, that is, the inner side of its lower surface is formed to have a predetermined curvature. Referring to FIGS. 5B and 5C, C and C' denote points of the membranes 55 which are positioned the closest to a substrate 51, and D and D' denote the centers of the membranes 55, which are positioned the farthest from the substrate 51. It is understood that the closer the points C and C' are to the points D and D' on the membranes 55, the more the distances between the membranes 55 and the substrates 51 is increased. For this reason, the shape of the membrane according to the present invention is very important. The voltages required to actuate the micro-switching devices of FIGS. 5B and 5C are different from each other, even though the sizes of the lower surfaces of the membranes 55, the spring constants of the springs 54, and stress grade values of the membranes 55 are set to be the same. For instance, a voltage of 10.3 V is required to actuate the rectangular membrane 55 of FIG. 5B, whereas a voltage of 3 V is sufficient to actuate the spherical membrane of FIG. 5C. That is, the driving voltage required by the spherical membrane of FIG. 5C is reduced to 30% of that required by the rectangular membrane of FIG. 5B.

In conclusion, the restoring capabilities of both the micro-switching devices of FIG. 5B and FIG. 5C are both better than those of a conventional micro-switching device having a planar membrane. However, since the micro-switching device of FIG. 5C having a spherical membrane has a predetermined inner curvature, it can be actuated by a lower voltage than the micro-switching device of FIG. 5B having a rectangular membrane. This is because the difference in height between the points C' and D' of the round membrane of FIG. 5C is less than that between the points C and D of the rectangular membrane of FIG. 5B having the same curvature and size. For this reason, a stronger electrostatic attraction operates on the round membrane of FIG. 5C than on the rectangular membrane of FIG. 5B, when a voltage is applied to the lower electrode. Also, the round membrane of FIG. 5C has greater geometric rigidity than the rectangular membrane of FIG. 5B, and thus has better restoring capability.

A micro-switching device according to the present invention is characterized in that the lower surface of its membrane is curved rather than planar. However, the shape of the membrane is not restricted. That is, the membrane may be formed to have the circumference of the lower surface protruding, or the center of the lower surface protruding. To guide the inner curvature of the membrane, a sacrificial layer may be formed generally on the membrane and the lower structure such as a lower electrode or a signal line, to have an inclination with regard to the circumference of the membrane, when manufacturing the micro switching device.

While the present invention has been particularly shown and described with reference to a preferred embodiment thereof, it will be understood by those skilled in the art that various changes in form and details may be made therein without departing from the spirit and scope thereof as defined by the appended claims.

As described above, a micro-switching device according to the present invention can be actuated by a low voltage, preventing the adhesion which commonly occurs in micro devices. According to the present invention, it is possible to fabricate a micro-switching device which can be actuated by a low voltage, and the concepts of the present invention can be easily applied to various micro devices by forming a concave portion or a protrusion on the lower surface of a membrane corresponding to a lower electrode.

What is claimed is:

1. A micro-switching device actuated by a low voltage, comprising:

a spring operating elastically;

a membrane formed on one side of the spring, being held by the spring; and a lower electrode formed below the membrane, for generating an electrostatic attraction when a voltage is applied thereto, wherein the membrane is non-planar.

2. The micro-switching device of claim 1, wherein the spring is formed on an anchor which is formed on a substrate.

3. The micro-switching device of claim 2, wherein the membrane is actuated not to be in contact with the substrate while being held by the spring.

4. The micro-switching device of claim 3 further comprising a signal line formed on the substrate and being in contact with the membrane when the membrane is actuated.

5. The micro-switching device of claim 1, wherein the lower surface of the membrane is formed such that its circumference has a lower curvature than its center.

6. The micro-switching device of claim 5, wherein the membrane is cut partially spherical.

7. The micro-switching device of claim 1, wherein the lower surface of the membrane is formed such that its circumference has a higher curvature than its center.

8. The micro-switching device of claim 6, wherein the membrane is cut partially spherical.

* * * * *